United States Patent [19]

Dickey

[11] 4,323,206

[45] Apr. 6, 1982

[54] REEL HOLDER HAVING BRAKE ACTION

[75] Inventor: Larry W. Dickey, Hackettstown, N.J.

[73] Assignee: Bell Telephone Laboratories, Incorporated, Murray Hill, N.J.

[21] Appl. No.: 192,075

[22] Filed: Sep. 29, 1980

[51] Int. Cl.[3] ..... B65H 49/00; B65H 59/16

[52] U.S. Cl. ..... 242/129.6; 242/129.8; 242/156

[58] Field of Search ..... 242/129.6, 129.8, 99, 242/86.7, 107.3, 156; 112/254, 255; 248/81, 82, 154, 680

[56] References Cited

U.S. PATENT DOCUMENTS

| | | | |
|---|---|---|---|
| 241,931 | 5/1981 | Coats | 242/129.6 |
| 3,467,336 | 9/1969 | Appleton | 242/99 X |
| 3,762,615 | 10/1973 | McCallister | 242/156 X |
| 3,850,379 | 11/1974 | Stern | 242/55.2 |

*Primary Examiner*—Edward J. McCarthy
*Attorney, Agent, or Firm*—J. W. Fisher

[57] ABSTRACT

Apparatus (10) is disclosed for mounting a reel (40) having a material (41) wound thereon. The apparatus includes a rigid support member (20) and a first projection (21) extending generally perpendicularly from the support member for holding the reel. Extending outwardly from the support member is a second projection (22) which is spaced apart from the first projection. Fastened to this second projection and coupled about an edge of the reel of the first projection are means (60, 61, 62, 63, 64, 65) for providing a braking action to the reel as material is drawn therefrom.

6 Claims, 2 Drawing Figures

REEL HOLDER HAVING BRAKE ACTION

BACKGROUND OF THE INVENTION

1. Technical Field of the Invention

This invention relates to unreeling apparatus and, in particular, to apparatus for providing a supply reel with a braking action.

2. Description of the Prior Art

In many telecommunications installations it is necessary to effect some form of cross-connection. This cross-connection is typically effected by a jumper wire. Since the required length of the jumper wire is not always known in advance, it has proved most efficient to provide a reel of jumper wire with the equipment wherein the cross-connection equipment is mounted. To facilitate removal of the jumper wire from the reel, the reel is often mounted, for example, on a cabinet door housing the equipment.

Although this arrangement is somewhat convenient, it is not free of drawbacks. In particular, the mere mounting of the wire reel on the cabinet door does not take into account the inherent tendency of the reel, once it is started into rotary motion, to continue such motion. Consequently, a reel holder having capability for providing a braking action as the reel is rotated is highly desirable.

One form of friction brake used with a sewing machine thread supply spool is disclosed in U.S. Pat. No. 3,762,615 issued to D. L. McCallister on Oct. 2, 1973. The McCallister device includes a pair of felt disks and a pair of felt wedges which are disposed between correspondingly diametrically opposite portions of the disks. A plastic strap is secured between the disks and between the wedges and the wedges and disks are in turn secured together. This assembly is slipped over a pin affixed to the horizontal portion of the sewing machine. Since the diameter of the apertures in the disks is smaller than the diameter of the pin, the disks and pin are held in frictional engagement.

At an opposite end of the plastic strap, there is another aperture on opposite sides of which are metal weights. After the felt disk assembly is fastened to the pin, a thin-walled sleeve is telescoped over it, the thread supply spool is slid over the sleeve and the weighted end of the strap coupled to the sleeve. The frictional engagement of the strap and the disk assembly with the supply spool tends to retard rotation of the spool and thus to prevent continued rotation of the spool in a thread unwinding direction in the event the operation of the sewing machine is suddenly terminated.

Another type of brake accessary that has been employed with toilet paper dispensers and the like is disclosed in U.S. Pat. No. 3,850,379 issued to M. Stern on Nov. 26, 1974. The Stern device is in the form of a spring clip that is made of a suitable material, such as steel, plastic or the like. The clip includes first and second legs that are joined by a curved portion. Each of the legs has an aperture through a central region for engaging the normal telescoping toilet paper holder spindle. On an outer surface of the leg nearest the roll is a tapered collar. This collar snugly fits into the end of the core of the roll. By virtue of the spring action exerted on the roll, the paper is prevented from being unwound too fast.

While both of the above-described devices serve a useful purpose, they are not readily usable for providing a braking action to a reel of wire. More specifically, the McCallister device requires that the supply spool be mounted horizontally or very close to horizontal. Since space within the telecommunications equipment cabinet is at a premium, such a mounting arrangement is not practical. As for the Stern device, it requires an already existing and in place roll mounting assembly. Consequently, there continues to exist a need for an inexpensive, easy to use, space saving, either horizontal or vertical mountable reel holder having capability for providing a braking action.

SUMMARY OF THE INVENTION

The heretofore described problems are overcome and the need satisfied in accordance with my invention of apparatus for mounting a reel having a material wound thereon. This apparatus includes a rigid support member and a first projection extending generally perpendicularly from the support member for holding the reel. Extending outwardly from the support member is a second projection which is spaced apart from the first projection. Fastened to this second projection and frictionally engaging an edge of the reel to the first projection are means for providing a braking action to the reel as material is drawn therefrom.

An additional advantage possessed by my apparatus is that the braking action providing means includes a strip of elastic material that has first and second oppositely directed tabs at one end. These tabs engage a first generally elongated slot which is positioned near an end of the second projection that is spaced apart from the rigid support member. This engagement is such that the tabs are located on the side of the second projection farthest away from the first projection. An intermediate region of the elastic strip is then looped over the first and second tabs and threaded through a second generally elongated slot juxtaposed the first slot in a generally parallel alignment. By virtue of this arrangement, the elastic strip is securely fastened to the second projection such that when the elastic strip is placed in tension any resulting tensile forces are incapable of unwrapping the looped strip end.

Another advantage possessed by my apparatus is that the first projection includes first and second oppositely directed generally semicircular tabs positioned at the end spaced apart from the rigid support member. These semicircular tabs in conjunction with an aperture in the elastic strip near its end opposite that having the two tabs thereon serve to couple the elastic strip about an edge of the reel and hold it in position between the first and second projections.

BRIEF DESCRIPTION OF THE DRAWINGS

The aforementioned advantages of my invention as well as other advantages will be better understood upon a consideration of the following detailed description and the appended claims taken in conjunction with the attached drawings of an illustrative embodiment in which:

DETAILED DESCRIPTION

Figure 1:
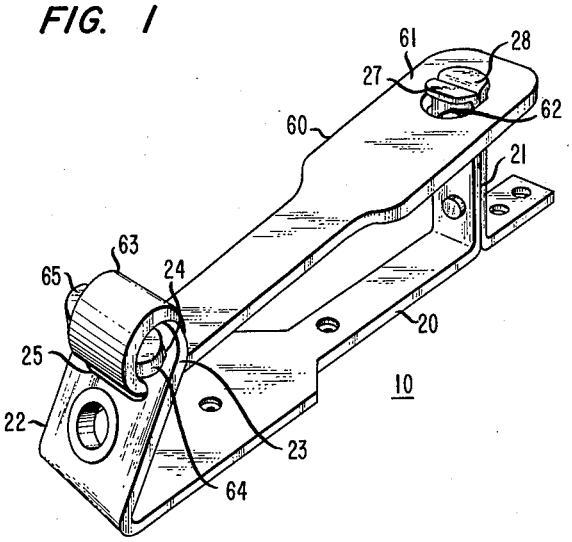
FIG. 1 is a perspective view of the reel holder having a braking action in accordance with the present invention.

Apparatus 10 in accordance with the present invention is illustrated in FIG. 1. The apparatus 10 includes a rigid support member 20 and a retaining strip 60.

Figure 2:
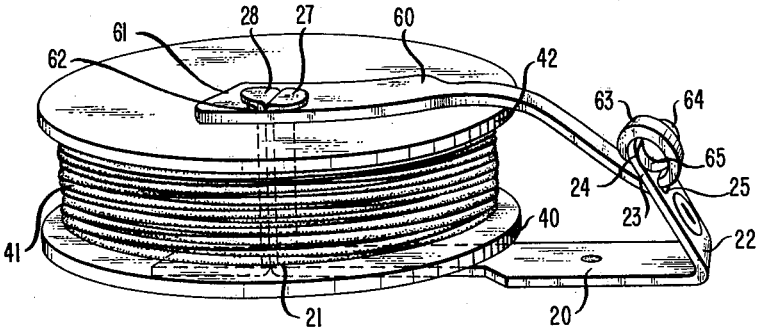
FIG. 2 is a side view illustrating the looping arrangement used to fasten the elastic strip to the second projection.

Support member 20 has extending generally perpendicularly therefrom at an intermediate position along its length a first projection 21. First projection 21, as shown in FIG. 2, is used to hold a reel 40 having a material 41, such as wire, wound thereon. Spaced apart from first projection 21 and extending outwardly from support member 20 is a second projection 22. Second projection 22 is somewhat shorter in length than first projection 21 and lies in a first plane which intersects second and third planes containing rigid support member 20 and first projection 21, respectively. Near end 23 of second projection 22, which end is spaced apart from rigid support member 20, are first and second generally parallel, elongated slots 24 and 25.

In order to provide a braking action to reel 40 as material 41 is drawn therefrom and also to retain reel 40 juxtaposed support member 20 to limit the amount of spaced used, there is fastened to second projection 22 and coupled about an edge 42 of reel 40 retaining strip 60. Retaining strip 60 is comprised of elastic material such as neoprene rubber. Near one end 61 of retaining strip 60 is aperture 62 for coupling strip 60 to first projection 21. It should be noted that end 61 of retaining strip 60 is somewhat wider than its intermediate region. At the opposite end 63 of retaining strip 50 are first and second oppositely directed tabs 64 and 65. Tabs 64 and 65 are integral with end 63 of strip 60.

End 63 of retaining strip 60 having tabs 64 and 65 thereon is fastened in slots 24 and 25 in second projection 22. This fastening is effected in such a way that the connection is positive and does not require any secondary or loose parts such as are used in common strap buckles.

As shown in FIG. 2, end 63 is looped through second elongated slot 25, around end 23 of second projection 22 and into first elongated slot 24. Thereafter first and second tabs 64 and 65 engage sidewalls and top edges of second projection 22 surrounding first slot 24. It should be noted that end 63 of retaining strip 60 having tabs 64 and 65 thereon is somewhat wider than the length of first slot 24. This shape holds end 63 in place when strip 60 is in a relaxed condition.

However, when strip 60 is placed in tension, as it is when coupled about edge 42 of reel 40 in order to provide a braking action to reel 40, the resulting tensile forces are incapable of unwrapping the looped strip end 63. The tensile forces cannot unwrap end 63 because the strain displacements around the loop are in one direction and friction acts to pull the tip in an opposite direction. As a result this action on the tip exceeds the tensile forces tending to unwrap the loop.

In order to facilitate removal and replacement of reel 40, first projection 21 includes first and second oppositely directed generally semicircular tabs 27 and 28. Tabs 27 and 28 are positioned at an end of first projection 21 which is spaced apart from rigid support member 20. These tabs 27 and 28 engage aperture 62 in end 61 of retaining strip 60 in order to hold strip 60 coupled to first projection 21.

In all cases, it is to be understood that the above-identified embodiment is illustrative of but a small number of many possible specific embodiments which can represent applications of the principles of the invention. Thus, numerous and various other embodiments can be devised readily in accordance with these principles by those skilled in the art without departing from the spirit and scope of the invention.

I claim:

1. Apparatus (10) for mounting a reel (40) having a material (41) wound thereon comprising:

a rigid support member (20);

a first projection (21), extending generally perpendicularly from said support member, for holding said reel; characterized in that said apparatus further includes;

a second projection (22) spaced apart from said first projection and extending outwardly from said support member; and means (60,61,62,63,64,65), fastened to said second projection and frictionally engaging an edge (42) of said reel to said first projection, for providing a braking action to said reel as said material is drawn therefrom.

2. The apparatus (10) in accordance with claim 1 wherein said second projecton (22) lies in a first plane which intersects second and third planes containing said rigid support member (20) and said first projection (21), respectively, and said second projection has first and second generally parallel, elongated slots (24,25) near an end (23) spaced apart from said rigid support member.

3. The apparatus (10) in accordance with claim 2 wherein said braking action providing means (60,61,62,63,64,65) comprises:

a strip (60) of elastic material having an aperture (62) near one end (61) thereof for coupling said strip to said first projection (21); and first and second oppositely directed tabs (64,65) integral with an opposite end (63) of said strip, said first and second tabs engaging said first elongated slot (24) from a direction away from said first projection and an intermediate region of said strip looped over said first and second tabs and threaded through said second elongated slot (25) such that when said strip is placed in tension any resulting tensile forces are incapable of unwrapping the looped strip end.

4. The apparatus (10) in accordance with claim 3 wherein said first projection (21) includes:

first and second oppositely directed generally semicircular tabs (27,28) positioned at an end spaced apart from said rigid support member (20), said semicircular tabs engaging said aperture (62) near said one end (61) of said strip (60) of elastic material.

5. Apparatus (10) for mounting a reel (40) having a material (41) wound thereon comprising:

a rigid support member (20);

a first projection (21) extending generally perpendicularly from said support member for holding said reel; characterized in that said apparatus further includes a second projection (22) spaced apart from said first projection and extending outwardly from said support member, said second projection lying in a first plane which intersects second and third planes containing said rigid support member and said first projection, respectively, said second projection having first and second generally parallel, elongated slots (24,25) extending transversally near an end (23) spaced apart from said rigid support member; and means (60,61,62,63,64,65), fastened to said second projection and frictionally engaging an edge (42) of said reel to said first projection, for providing a braking action to said reel as said material is drawn therefrom.

6. The apparatus (10) in accordance with claim 5 wherein said braking action providing means (60,61,62,63,64,65) comprises;

a strip (60) of elastic material having an aperture (62) near one end (61) thereof for coupling said strip to said first projection (21); and first and second oppositely directed tabs (64.65) integral with an opposite end (63) of said strip, said first and second tabs engaging said first elongated slot (24) from a direction away from said first projection and an intermediate region of said strip looped over said first and second tabs and threaded through said second elongated slot (25) such that when said strip is placed in tension any resulting tensile forces are incapable of unwrapping the looped strip end.

* * * * *